US006113414A

United States Patent [19]

Fukuda

[11] Patent Number: 6,113,414

[45] Date of Patent: Sep. 5, 2000

[54] CONNECTOR HAVING A SLIDING, LOCKING MEMBER FOR ENSURING PROPER CONNECTION

[75] Inventor: Masaru Fukuda, Shizuoka, Japan

[73] Assignee: Yazaki Corporation, Tokyo, Japan

[21] Appl. No.: 09/285,885

[22] Filed: Apr. 7, 1999

[30] Foreign Application Priority Data

Apr. 8, 1998 [JP] Japan ..... 10-095942

[51] Int. Cl.[7] ..... H01R 13/627

[52] U.S. Cl. ..... 439/352

[58] Field of Search ..... 439/352, 357, 439/358

[56] References Cited

U.S. PATENT DOCUMENTS 5,207,593 5/1993 Bogiel ..... 439/352

FOREIGN PATENT DOCUMENTS 62-176987 11/1987 Japan .
63-20378 2/1988 Japan .
5-1178 1/1993 Japan .
11-067359 3/1999 Japan .

*Primary Examiner*—Lincoln Donovan
*Assistant Examiner*—Javaid Nasri
*Attorney, Agent, or Firm*—Morgan, Lewis & Bockius LLP

[57] ABSTRACT

A connector lock structure includes a female connector housing (10) having a connector fitting chamber (11), a male connector housing (4) having an engagement projection (9), and a slide member (3) mounted on the female connector housing for sliding movement in a direction perpendicular to a connector fitting direction. An elastic lock arm (13) is formed on the female connector housing (10), and a flexure reception portion (17) for receiving the lock arm is provided at the slide member (3). The engagement projection (9) raises the lock arm (13) into the flexure reception portion, and an inner side surface of the flexure reception portion (17) abuts against a side surface of the lock arm. That portion of a bottom surface (19) of the slide member, disposed adjacent to the flexure reception portion (17), abuts against that surface of the lock arm (13) facing in a direction of flexing of the lock arm. A slide protuberance (8) is formed on the male connector housing (4), and a guide groove (23) is formed in the female connector housing (10), and a provisionally-retaining arm (24) is formed on the slide member (3). The provisionally-retaining arm is engaged in the guide groove (23), and is pressed by the slide protuberance (8), thereby canceling a provisional retainment.

14 Claims, 7 Drawing Sheets

CONNECTOR HAVING A SLIDING, LOCKING MEMBER FOR ENSURING PROPER CONNECTION

BACKGROUND OF THE INVENTION

1. Field of the Invention

The present invention relates to a connector lock structure in which an incompletely-fitted condition of male and female connectors can be detected through a slide member mounted on the female connector, and also a lock arm on the female connector can be positively locked.

The present application is based on Japanese Patent Application No. Hei. 10-95942, which is incorporated herein by reference.

2. Description of the Related Art

FIG. 9 shows an example of a connector lock structure. In the structure, an elastic lock arm 49 is formed on a male connector housing 48 of a male connector 46 for connection to a wire harness, and an engagement projection 51 for engagement with the lock arm 49 is formed on a female connector housing 50 of a female connector 47 for connection to an equipment.

In many cases, the female connector housing 50 for connection to the equipment is required to have a heat resistance, and the lock arm 49 of high elasticity can not be easily formed of a heat-resistant resin. In the case where the lock arm 49 is provided on the female connector housing 50 for connection to the equipment, there arises a problem that the operability is poor when canceling the locked condition. Therefore, the lock arm 49, including a cancellation operating portion 52, is provided on the male connector housing 48 for connection to the wire harness.

In the above construction, however, the lock arm 49 projects from the male connector housing 48, and therefore there is a possibility that the lock arm 49 is deformed and damaged by an impact, resulting from the dropping of the connector, or the interference of the wires with the lock arm when the wire harness is moved around during the production and packing of the wire harness and during the installation of the wire harness in an automobile. Furthermore, there is a possibility that the two connectors 46 and 47 are increased in size and that the automatic supply of the male connector housings 48 and the male connectors 46 is difficult.

FIG. 10 shows an improved connector lock structure for eliminating the above-described possibilities. In this structure, a separate slide member 54 for locking purposes is provided on a female connector housing 53 for connection to an equipment, and an engagement projection 56 for engagement with the slide member 54 is provided on a male connector housing 55 for connection to a wire harness.

The slide member 54 is slidable in a direction perpendicular to a connector fitting direction, and the slide member 54 has elastic lock arms 58 corresponding respectively to connector fitting chambers 57 in the female connector housing 53. The lock arm 58 has a downwardly-directed, retaining projection 59 for engagement with the engagement projection 56. Insertion grooves 60, each extending in the connector fitting direction for the passage of the engagement projection 56 therethrough, are formed in the female connector housing 53, and are disposed beneath the lock arms 58, respectively. Removal guide grooves 61 for the engagement projections 56 are formed in the slide member 54, and are disposed in parallel, adjoining relation to the insertion grooves 60, respectively. Female terminals (not shown) each connected to a wire 62 are received in the male connector housing 55, thus forming a male connector. Male terminals (not shown) for connection to the equipment are provided in a projected manner in the female connector housing 53, thus forming a female connector.

For fitting the male and female connectors together, the engagement projection 56 is passed through the insertion groove 60, and is brought into engagement with the retaining projection 59 of the lock arm 58. For disconnecting the two connectors from each other, the slide member 54 is slid in a direction of arrow A, and accordingly, the engagement projection 56 can be withdrawn to the exterior through the removal guide groove 61 with almost no resistance, and therefore the connectors can be easily disconnected from each other.

In the above structure, when the male connector (connector housing 55) is incompletely fitted (or half fitted) in the female connector (connector housing 53), there is not provided any mechanism for detecting it. Therefore, there is a possibility that the connectors, kept in such a half-fitted condition, is transferred to the next step of the assembling process. And besides, there is provided no mechanism for preventing the flexing (elastic deformation) of the lock arm 58 when the lock arm 58 is kept engaged with the engagement projection 56, and therefore there is a possibility that when the male connector (connector housing 55) is pulled hard, the male connector is disengaged from the female connector (connector housing 53).

SUMMARY OF THE INVENTION

Therefore, it is an object of the present invention to provide a connector lock structure in which a half-fitted condition of connectors can be positively detected, and also the fitting connection between the connectors can be positively locked.

To achieve the above object, according to the first aspect of the present invention, there is provided a connector lock structure which comprises a female connector housing having a connector fitting chamber, a male connector housing insertable into the connector fitting chamber, the male connector housing having an engagement projection, a slide member mounted to the female connector housing so that the slide member is slidable in a direction perpendicular to a connector fitting direction, an elastic lock arm disposed in the female connector housing, and a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm. According to the second aspect of the present invention, preferably, a portion of a bottom surface of the slide member, disposed adjacent to the flexure reception portion, can abut against a surface of the lock arm facing in a direction of flexing of the lock arm. According to the third aspect of the present invention, preferably, the connector lock structure further comprises a guide groove formed in the female connector housing, a slide protuberance formed on the male connector housing, wherein, when the male connector housing is inserted into the connector fitting chamber, the slide protuberance is guided by the guide groove, and an elastic, provisionally-retaining arm formed on the slide member, wherein the slide member is provisionally retained to the female connector housing so that the provisionally-retaining arm is engaged with the guide groove, and wherein, when the male connector housing is inserted into the connector fitting chamber, the provisionally-retaining arm is pressed by the slide protuberance, so that a provisional retainment of the slide member is canceled. According to the fourth aspect of the present invention, preferably, a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

In the structure according to the first aspect, for fitting the connectors together, the engagement projection advances while raising the lock arm, and when the engagement projection passes the lock arm, the lock arm is restored into its original position, so that the engagement projection abuts against a front end of the lock arm, thereby preventing the male connector housing from being withdrawn from the female connector housing. If the male connector housing is incompletely fitted (half fitted) in the connector fitting chamber, the lock arm is kept raised and received in the flexure reception portion of the slide member. In this condition, even if trying to slide the slide member, the inner side surface of the flexure reception portion abuts against the side surface of the lock arm, and therefore the slide member can not be slid, so that the half-fitted condition can be detected.

In the structure according to the second aspect of the present invention, when the two connector housings are completely fitted together, the bottom surface of the slide member is held against the lock arm, thereby preventing the lock arm from being flexed, and therefore the locking of the connector can be effected positively.

In the structure according to the third aspect of the present invention, before the engagement projection flexes and passes the lock arm to be retainingly engaged therewith, the slide member is provisionally retained relative to the female connector housing. When the male connector housing is fitted into the connector fitting chamber, the slide protuberance raises the provisionally-retaining arm to thereby cancel the provisional retainment, so that the slide member can be slid. In an incompletely-fitted condition of the male connector housing, the provisional retainment can not be canceled, and this half-fitted condition can be detected in a double manner thanks to this effect and the effect of the flexure reception portion as defined in the first aspect.

In the structure according to the fourth aspect of the present invention, the plurality of male connector housings are fitted respectively into the connector fitting chambers in the female connector housing. In this case, if any of the male connector housings is in an incompletely-fitted condition, the slide member can not be slid thanks to the above effect, achieved by the lock arm and the flexure reception portion, and the above effect achieved by the provisionally-retaining arm and the slide protuberance.

DETAILED DESCRIPTION OF THE PREFERRED EMBODIMENT

A preferred embodiment of the present invention will now be described in detail with reference to the drawings.

Figure 1:
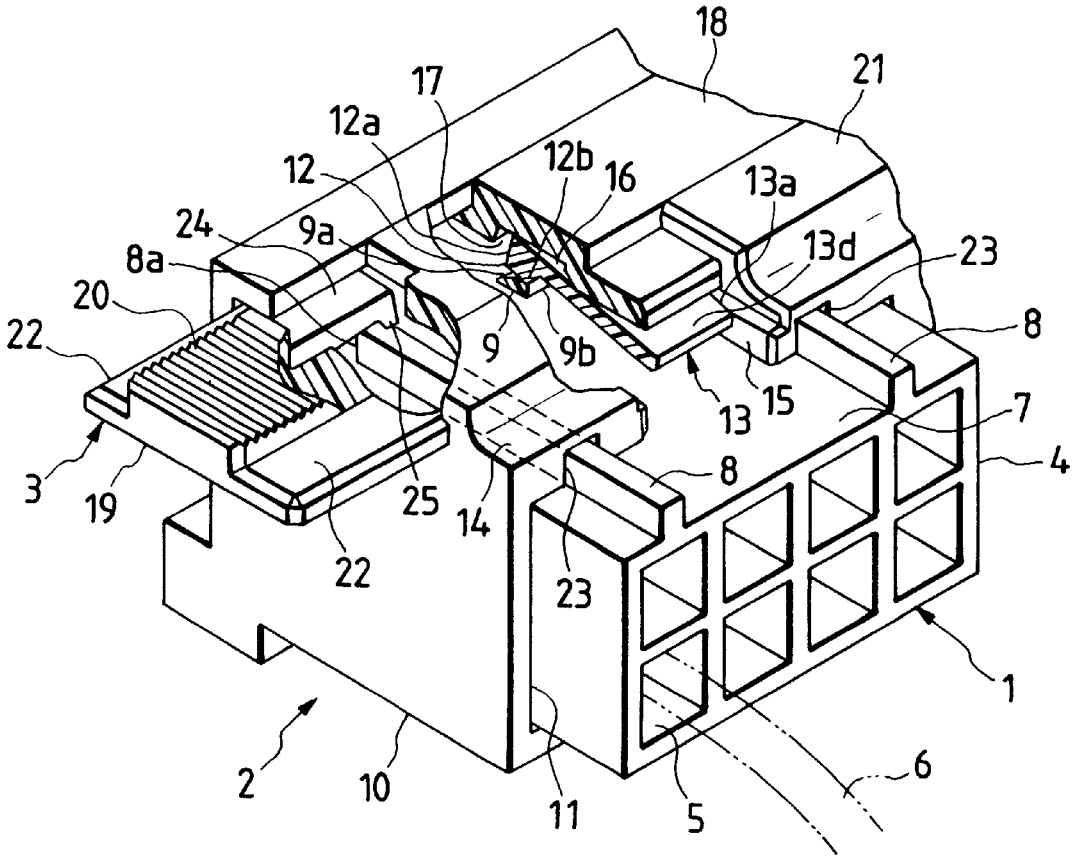
FIG. 1 is a perspective view of one preferred embodiment of a connector lock structure of the present invention.
Figure 2:
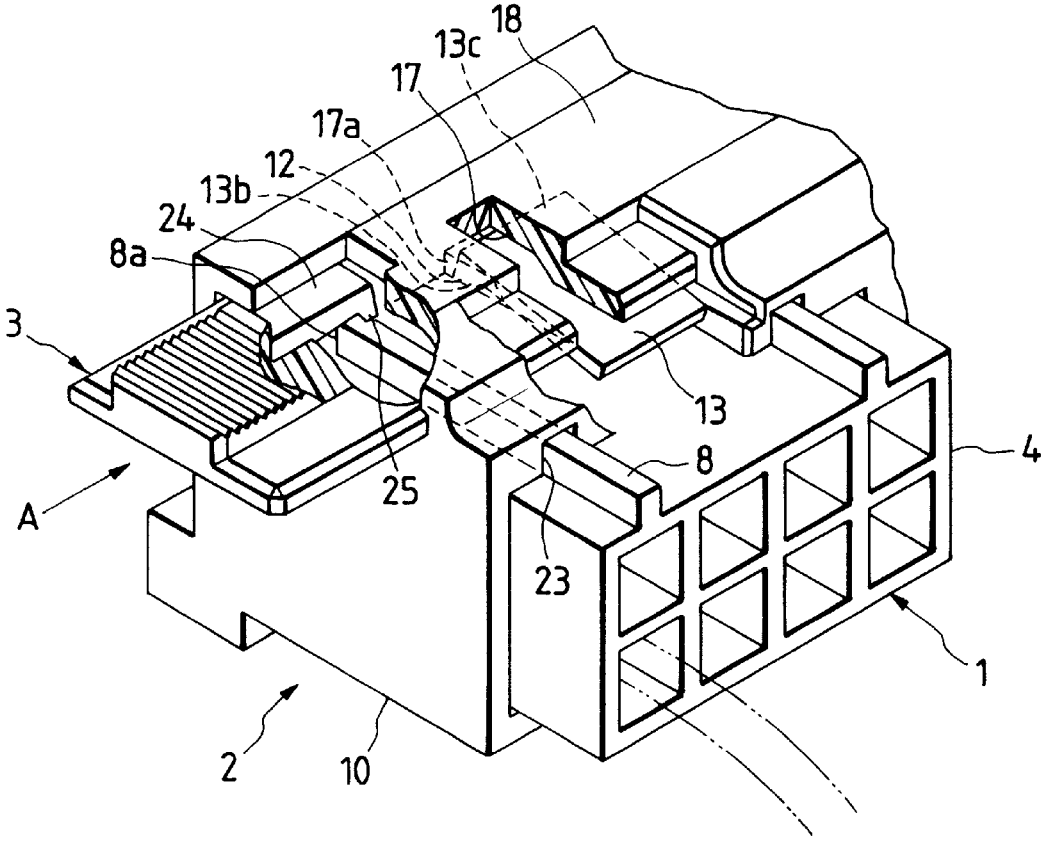
FIG. 2 is a perspective view showing a condition in which an inner side surface of a recessed groove in a slide member abuts against a lock arm, thereby detecting a half-fitted condition of a connector.

FIGS. 1 to 2 show one preferred embodiment of a connector lock structure of the present invention. In FIG. 1, reference numeral 1 denotes a male connector, reference numeral 2 a female connector, and reference numeral 3 a slide member. In this example, the connector to be inserted is defined as the male connector 1, and the connector for receiving the mating connector is defined as the female connector 2.

The male connector 1 comprises a male connector housing 4 made of a synthetic resin, and female terminals (not shown) received respectively in terminal receiving chambers 5. The female terminals are connected to a wire harness (wires) 6. The male connector housing 4 has a pair of elongate slide protuberances 8 and 8 formed on an upper wall 7 thereof, and an engagement projection 9 is formed on this upper wall, and is disposed between the pair of slide protuberances 8 and 8.

The female connector 2 comprises a female connector housing 10 made of a synthetic resin, and male terminals (not shown) provided in a connector fitting chamber 11. An elastic lock arm 13 is formed integrally on the female connector housing 10, and has a retaining projection 12 for engagement with the engagement projection 9.

A notch (opening) 15 for the passage of the engagement projection 9 therethrough is formed in an upper wall 14 of the female connector housing 10. Central portions of opposite side edges (side surfaces) 13*a* and 13*b* (FIG. 2) of the lock arm 13 are integrally connected respectively to opposite side edges (designated at 15) of the notch 15. The lock arm 13 can be flexed in a seesaw manner. The lock arm 13 extends in a connector fitting direction, and has the downwardly-directed, retaining projection 12 formed at its distal end. A rear end of the retaining projection 12 is formed into an arcuate or a slanting configuration to provide a slanting surface 12*b* for sliding contact with a slanting front surface 9*a* of the engagement projection 9. The front end of the retaining projection 12 is formed into a vertical abutment surface 12*a* for engagement with a vertical rear surface 9*b* of the engagement projection 9. The free end portion of the lock arm 13 remote from the retaining projection 12 serves as a flexure operating portion 13*d*.

For fitting the connectors together, the engagement projection 9 advances along the slanting surface 12*b* of the retaining projection 12 to press and flex the lock arm 13 upwardly. Simultaneously when the two connectors 1 and 2 are completely fitted together, the engagement projection 9 passes the retaining projection 12, so that the abutment surface 12*a* of the retaining projection 12 abuts against the vertical rear surface 9*b* of the engagement projection 9, thereby preventing the rearward withdrawal of the male connector 1.

A recessed groove (flexure reception portion) 17, serving as a flexure space for the lock arm 13, is formed in the slide member 3. When the lock arm 13 is pressed upwardly by the engagement projection 9, held in sliding contact with the retaining projection 12, during the connector-fitting operation, the front half portion of the lock arm 13, having the retaining projection 12, enters the recessed groove 17.

The slide member 3 is in the form of an elongate plate made of a synthetic resin, and has such a convex shape that its central portion is higher than its opposite side portions. The recessed groove 17 is formed at a bottom 19 of this central portion 18. The recessed groove 17 has a rectangular shape, and as shown in FIG. 2, one inner side surface 17*a* of the recessed groove 17 serves as an abutment surface (detection surface) for detecting a half-fitted condition. An anti-slip portion 20 is formed at the central portion 18 of the slide member 3 at a proximal end portion thereof.

Even if trying to slide the slide member 3 in a direction (as indicated by arrow A in FIG. 2) perpendicular to the connector fitting direction in a half-fitted condition of the connectors 1 and 2 (in which the lock arm 13 is flexed upwardly, with its front half portion received in the recessed groove 17), the inner side surface 17*a* of the recessed groove 17 abuts against the front half portion of the side edge 13*b* of the lock arm 13, thereby preventing the sliding movement of the slide member 3. Therefore, the half-fitted condition of the connector can be detected.

The opposite side portions (front and rear side portions with respect to the connector fitting direction) 22 and 22 of the slide member 3 are slidably engaged respectively with a pair of front and rear slide guides 21 and 21 of the female connector housing 10, and the central portion 18 of the slide member 3 is slidably disposed between the pair of slide guides 21 and 21, and is engaged therewith. Guide grooves 23 for respectively receiving the pair of slide protuberances 8 and 8 of the male connector housing 4 are formed in the female connector housing 10, and extend in the connector fitting direction. A provisionally-retaining arm 24 of an elastic nature for sliding contact with a front end 8*a* of one slide protuberance 8 is formed on the slide member 3.

The provisionally-retaining arm 24 extends in the direction of the length of the slide member 3, that is, in a direction perpendicular to the connector fitting direction, and this arm 24 has a downwardly-directed projection 25 formed at its distal end. The projection 25 is engaged in the guide groove 23 in the female connector housing 10 so as to face the front end 8*a* of the slide protuberance 8. The front end 8*a* of the slide protuberance 8 is brought into sliding contact with the lower side of the projection 25 to flex the provisionally-retaining arm 24 upwardly, thereby canceling the provisional retainment. The slide member 3 is provisionally retained on the female connector housing 10, with the projection 25 engaged in the guide groove 23, and therefore the movement of the slide member 3 is prevented. In the provisionally-retained condition of the slide member 3, the engagement projection 9 of the male connector housing 4 is brought into engagement with the lock arm 13 of the female connector housing 10. Namely, the male connector 1 can be fitted into the female connector 2.

For fitting the male connector 1 into the female connector 2, the front end 8*a* of the slide protuberance 8 raises the provisionally-retaining arm 24 to cancel the provisional retainment, so that the slide member 3 can be slid. If the connectors 1 and 2 are in a half-fitted condition, the inner side surface 17*a* of the recessed groove 17 in the slide member 3 abuts against the side edge 13*b* of the lock arm 13 as described above for FIG. 2, and therefore the slide member 3 can not be moved or pushed, so that this abnormal condition can be detected.

At the same time, the provisionally-retaining arm 24 also serves as a connector half-fitting detection member. More specifically, if the male connector 1 is incompletely fitted in the female connector 2, the slide protuberance 8 does not contact the provisionally-retaining arm 24, and therefore the projection 25 of the provisionally-retaining arm 24 is kept engaged in the guide groove 23 in the female connector housing 10, so that the slide member 3 can not be slid.

When the connectors 1 and 2 are completely fitted together, the lock arm 13 is restored into a horizontal position, and also the locking of the provisionally-retaining arm 24 is canceled, and the slide member 3 can be operated to be moved, and that portion of the thickened central portion 18 of the slide member 3, at which the recessed groove 17 is not provided, contacts an upper surface (that surface facing in the direction of flexing) 13*c* of the lock arm 13, thereby preventing the upward flexing of the lock arm 13. Therefore, the reliability of the connector-locking operation is enhanced.

The above construction can be applied not only to the female connector 2, adapted to be directly mounted on an equipment, but also a connector for an ordinary wire harness which is adapted to be connected alone. Although the retaining projection 12 of the lock arm 13 enhances the ability of retaining the engagement projection 9, and also enhances the abutting engagement of the inner side surface 17*a* of the recessed groove 17 with the lock arm, a lock arm in the form of a flat plate can achieve these effects. The recessed groove 17, serving as the flexure reception portion, may be replaced by a rectangular through hole. Although the elongate slide protuberances 8 also serve as positioning means for positioning the male connector 1, these elongated protuberances 8 may be replaced by slide projections, and even in this case, the locking of the provisionally-retaining arm 24 can be canceled.

The slide projection 8 may be designed only to cancel the provisional retainment, and may have nothing to do with the detection of the connector half-fitting. Namely, if the locking of the provisionally-retaining arm 24 is canceled simultaneously when the lock arm 13 is restored into its original position upon passing of the engagement projection 9 past the lock arm 13, a connector half-fitted condition can be detected in a double manner. If the cancellation of the locking of the provisionally-retaining arm 24 is earlier than the restoration of the lock arm 13, the connector half-fitted condition can be detected only through the lock arm 13. The positions of the various portions 9, 12, 13, 17, 8*a*, 24 and 25 can be suitably determined in order to achieve such arrangements.

FIGS. 3 to 8 show an example in which a plurality of male connectors 1 are fitted into a female connector 2 having a plurality of juxtaposed connector fitting chambers 11. Important portions of this construction are similar to those of the preceding embodiment, and only details are slightly different. Such different portions will be designated by identical reference numerals each having a dash (') affixed thereto.

Figure 3:
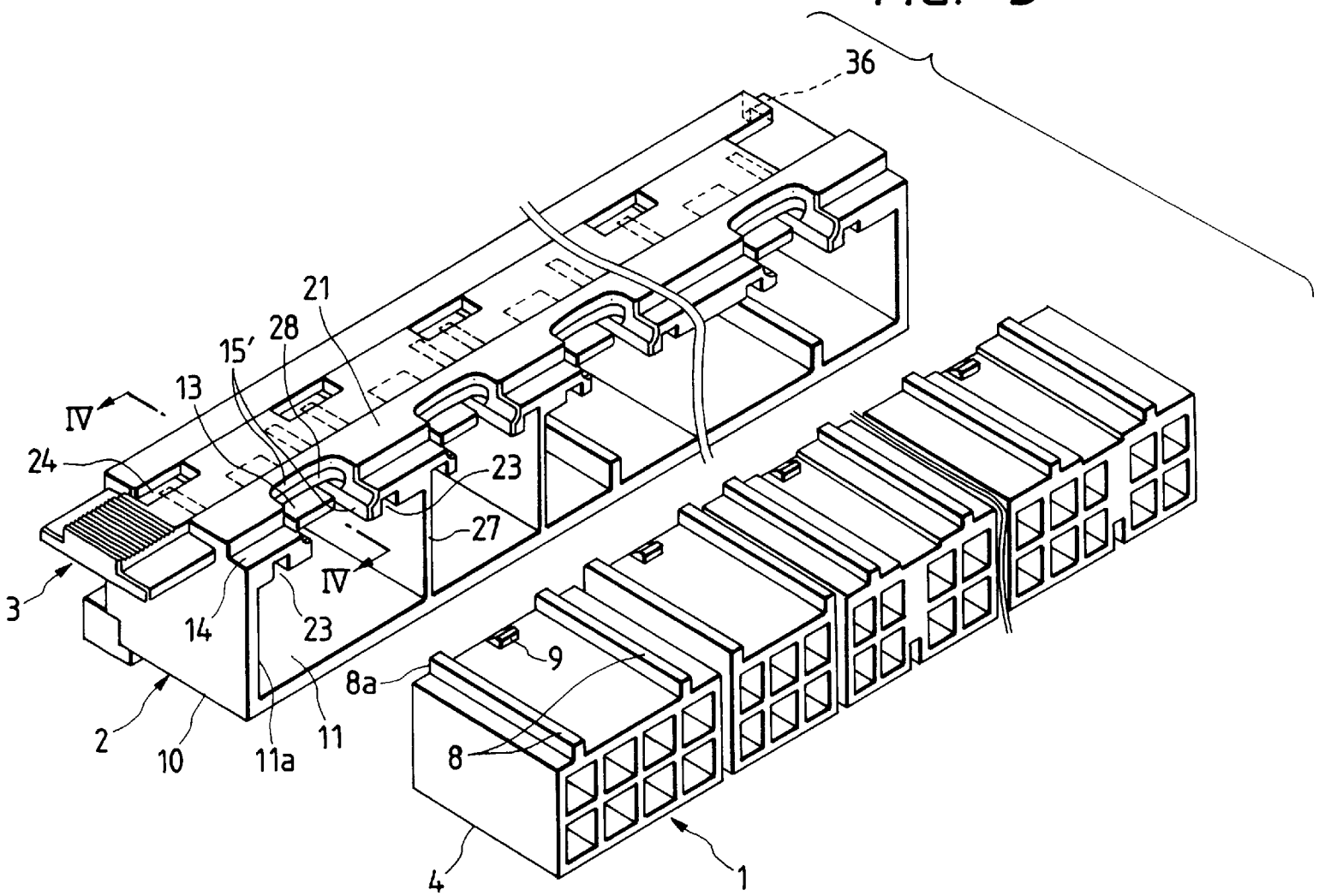
FIG. 3 is an exploded, perspective view showing a construction in which a plurality of male connectors are fitted into a female connector.

In FIG. 3, a female connector housing 10 is directly mounted, for example, on an equipment or a unit. The female connector housing 10 has the connector fitting chambers 11 of different sizes, and the connector fitting chambers 11 are separated from one another by partition walls 27. A lock arm 13, a notch (opening) 15' and guide grooves 23 are provided at an upper wall 14 of each of the connector fitting chambers 11. The notch 15' is disposed near to an operating portion 13*d* of the lock arm 13, and the notch 15' extends from an open front side (front opening) 11*a* of the connector fitting chamber 11 to an intermediate portion of a front slide guide 21. A slide member 3 has notches 28 formed in one side edge portion thereof, and the notch 28 corresponding in shape to the notch 15'.

One of the pair of guide grooves 23 intersects an associated provisionally-retaining arm 24 of the slide member 3, and a projection, formed on a distal end of the provisionally-retaining arm 24, is engaged in this guide groove 23. The provisionally-retaining arm 24 is contacted and pressed by one of a pair of elongate slide protuberances 8 and 8 of the male connector housing 4, thereby canceling the retainment.

Figure 4:
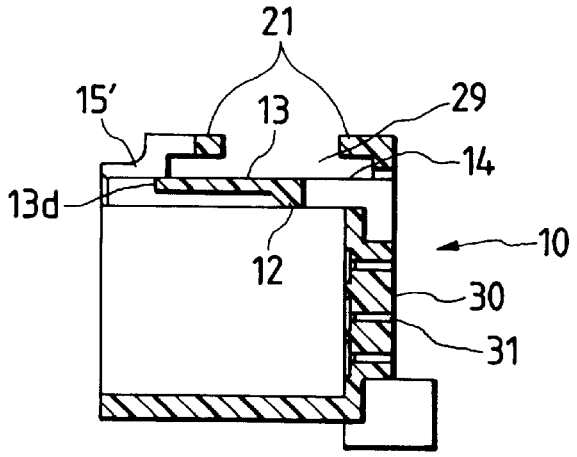
FIG. 4 is a vertical cross-sectional view taken along the line IV—IV of FIG. 3.

FIG. 4 is a vertical cross-sectional view of the female connector housing 10. The pair of front and rear slide guides 21 have an L-shaped cross-section, and the slide member 3 (FIG. 3) is engaged in a space 29 of a generally convex shape formed by the upper wall 14 of the female connector housing 10 and the two slide guides 21. The notch 15' is formed in the front slide guide 21, and at a region beneath the notch 15', central portions of opposite side portions of the lock arm 13 are continuous with the upper wall 14. The lock arm 13 extends horizontally toward the rear slide guide 21, and a downwardly-directed retaining projection 12 of the lock arm 13 is disposed generally midway between the pair of slide guides 21.

Holes 31 is formed through a rear wall 30 of the female connector housing 10, and male tab terminals (not shown), connected to the equipment, are press fitted into these holes 30, respectively. The male tab terminals are connected to a printed circuit board of the equipment (not shown). The retained condition of the lock arm 13 can be easily canceled by pressing the operating portion downwardly.

Figure 5:
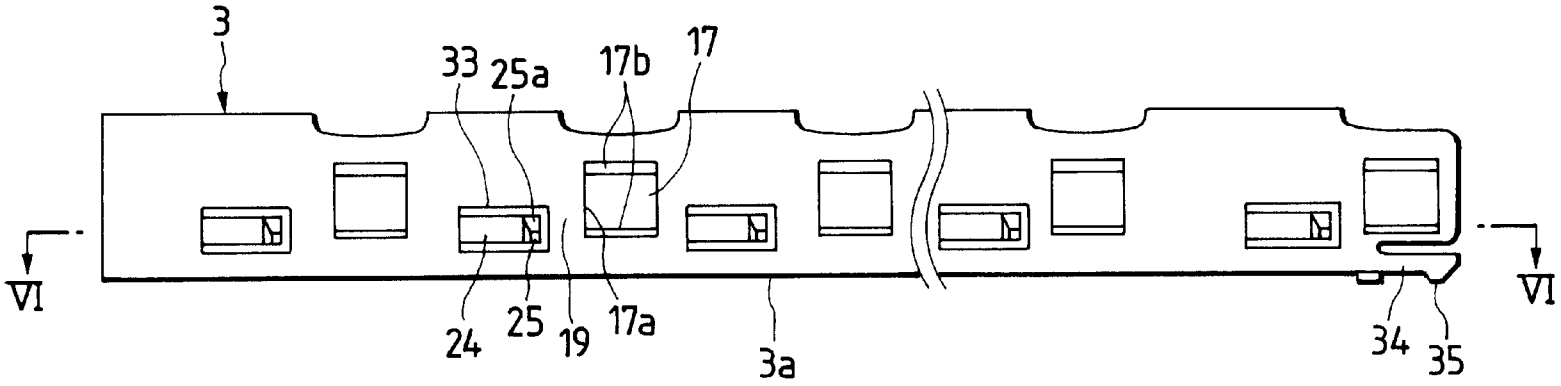
FIG. 5 is a bottom view of a slide member.
Figure 6:
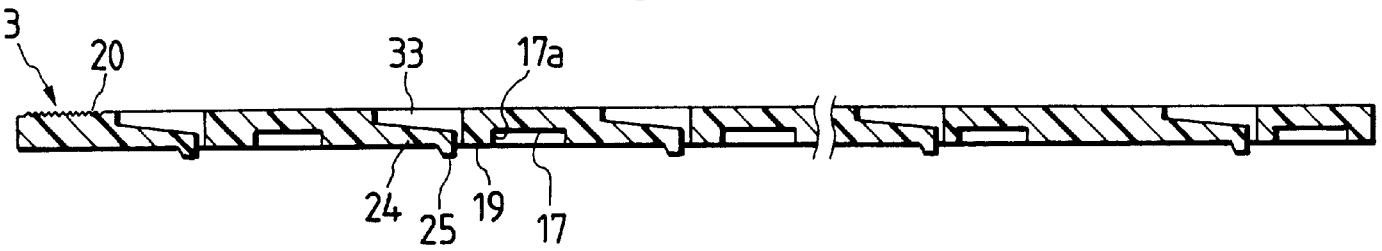
FIG. 6 is a vertical cross-sectional view taken along the line VI—VI of FIG. 5.

FIG. 5 is a bottom view of the slide member 3, and FIG. 6 is a vertical, longitudinal cross-sectional view of the slide member 3. Recessed grooves (flexure reception portions) 17 of a rectangular shape are disposed centrally of the width of the slide member 3, and the provisionally-retaining arms 24 are provided adjacent to one sides of the recessed grooves 17, respectively, and are disposed near to a front edge 3*a* of the slide member 3. The recessed groove 17 has left and right inner side walls (one 17*a* of which serves as an abutment surface for an engagement projection 9 (see FIG. 3)) which are spaced from each other in the direction of the length of the slide member 3, and the recessed groove 17 also has front and rear slanting surfaces disposed perpendicular to the inner side surface 17*a*.

Each provisionally-retaining arm 24 can be flexed (elastically deformed) upward and downward in an associated opening 33 formed in the slide member 3, and the projection 25, formed on the distal end of the provisionally-retaining arm 24, projects downwardly beyond a bottom surface 19 of the slide member 3 as shown in FIG. 6, and this arm 24 also has a large forwardly-directed, slanting surface 25*a* as shown in FIG. 5. A front end 8*a* (see FIG. 3) of the slide protuberance 8 is brought into sliding contact with the forwardly-directed slanting surface 25*a* to flex the provisionally-retaining arm 24 upwardly, thereby canceling the provisional retainment.

One completely-retaining arm 34 is formed at a distal end of the slide member 3 directed in the direction of sliding of the slide member 3. The completely-retaining arm 34 has an outwardly-directed projection 35, and this projection 35 is brought into engagement with a step portion 36 (FIG. 3), formed at one end of the female connector housing 10, thereby completely retaining the slide member 3. An anti-slip portion 20 for facilitating the operation of the slide member 3 is formed at the proximal end portion of the slide member 3.

Figure 7:
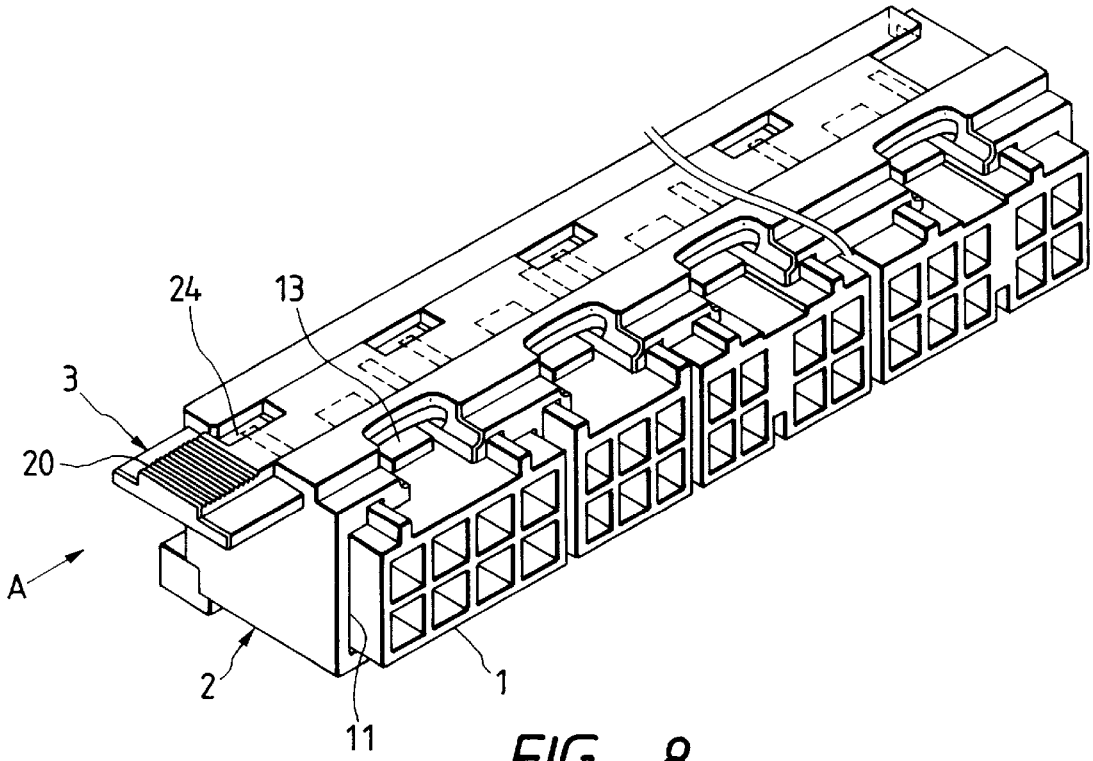
FIG. 7 is a perspective view showing a condition in which the plurality of male connectors are fitted in the female connector.

When the male connectors 1 are fitted respectively into the connector fitting chambers 11 in the female connector 2 as shown in FIG. 7, the provisional retainment of the slide member 3 is canceled, and the slide member 3 can be pushed or moved in a direction of arrow A. Here, if any of the plurality of male connectors 1 is in a half-fitted condition, the slide member 3 can not be pushed, so that the connector half-fitted condition is detected. This is achieved since the recessed groove 17, having the abutment surface (inner side surface) 17*a* (FIG. 5), and the provisionally-retaining arm 24 are provided for each connector fitting chamber 11.

Figure 8:
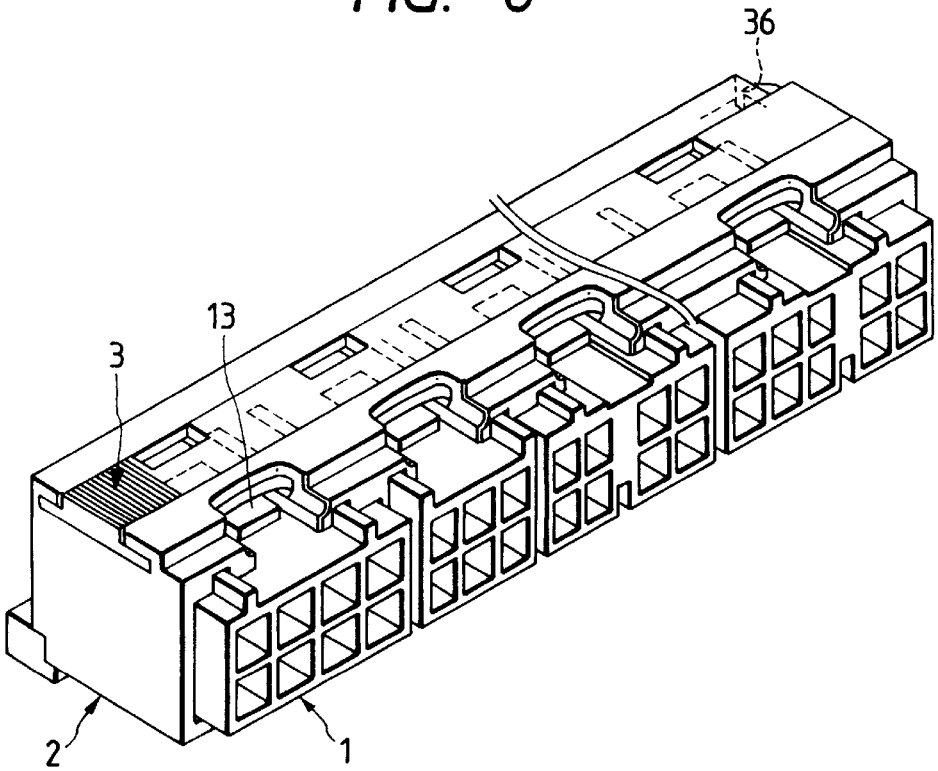
FIG. 8 is a perspective view similar to FIG. 7, but showing a condition in which the slide member is slid.
Figure 9:
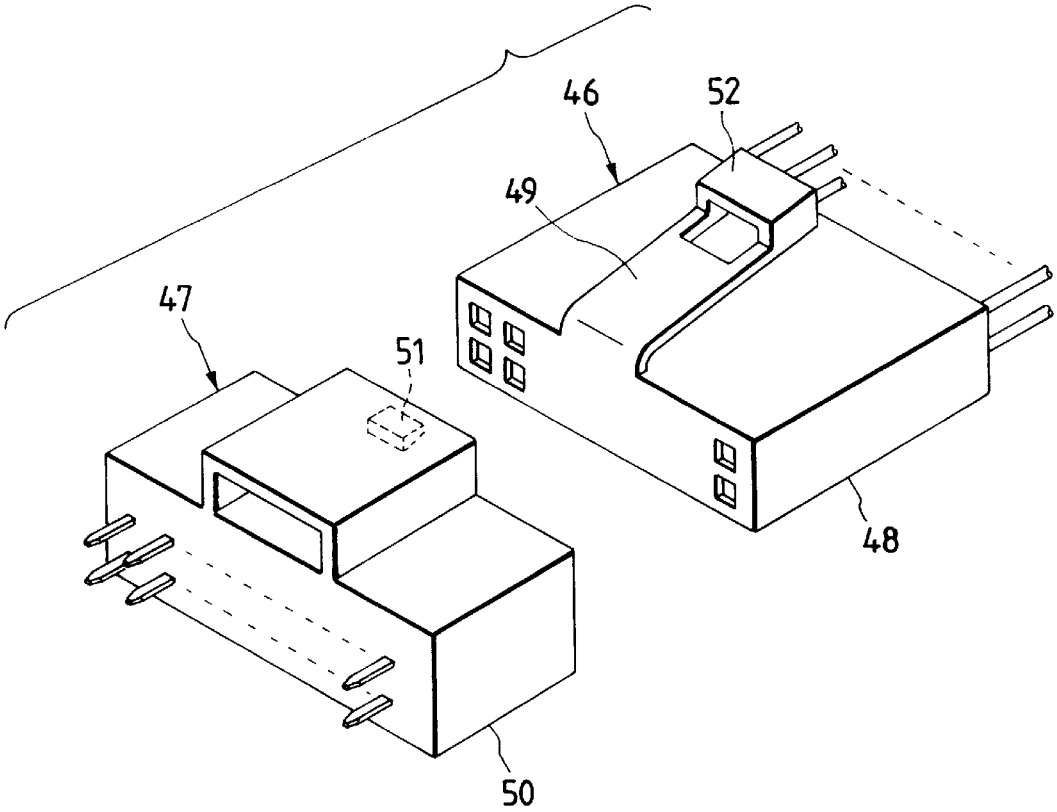
FIG. 9 PRIOR ART
FIG. 9 is an exploded, perspective view of a prior art connector lock structure.
Figure 10:
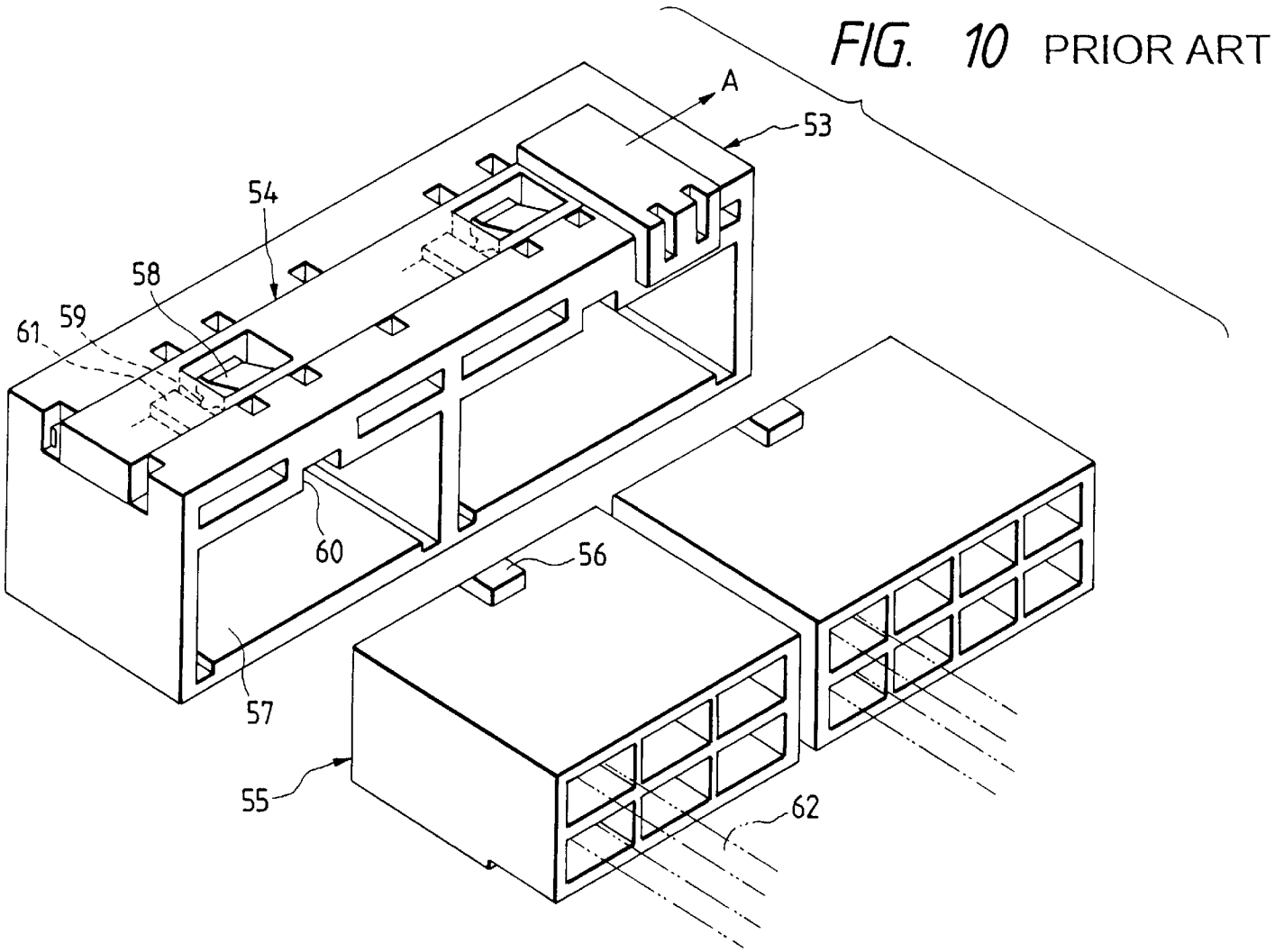
FIG. 10 PRIOR ART
FIG. 10 is an exploded, perspective view of a prior art connector lock structure.

When all of the male connectors 1 are completely fitted, the slide member 3 can be completely pushed as shown in FIG. 8. The front end (the retaining projection 12 in FIG. 4) of each lock arm 13 is disposed in contact with the engagement projection 9 (FIG. 3) of the male connector 1. Each recessed groove 17 is disposed out of registry with the lock arm 13, and the bottom surface 19 (FIG. 5) of the slide member 3 is disposed in close proximity to the upper surface of the lock arm 13, thereby preventing the upward flexure of the lock arm 13. Therefore, the engagement projection 9 (FIG. 3) is completely locked, thereby preventing the withdrawal of the male connector 1. The completely-retaining arm 34 (FIG. 5) is engaged with the step portion 36 of the female connector housing 10, thereby fixing the slide member 3 against movement.

For canceling the locking of the connector, the locking of the completely-retaining arm 34 is canceled, and the slide member 3 is pulled back to the provisionally-retained position of FIG. 7, and the operating portion 13*d* of the lock arm 13 is pressed down, thereby canceling the engagement between the retaining projection 12 and the engagement projection 9 of the male connector 1, and the male connector 1 is withdrawn from the female connector 2.

As described above, in the present invention, if the male connector housing is half fitted in the connector fitting chamber, the lock arm is kept raised and received in the flexure reception portion of the slide member. In this condition, even if trying to slide the slide member, the inner side surface of the flexure reception portion abuts against the side surface of the lock arm, and therefore the slide member can not be slid, so that the half-fitted condition can be detected. In the present invention, when the slide member is moved in the completely-fitted condition of the connectors, the bottom surface of the slide member prevents the lock arm from being flexed, and therefore the locking of the connector can be effected positively. Therefore, the male connector housing is prevented from being accidentally withdrawn. In the present invention, the position of the slide member is set by the provisionally-retaining arm when fitting the connectors together. In a half-fitted condition of the connector, the provisional retainment can not be canceled, and the slide member can not be slid, and therefore the half-fitted condition of the connector can be detected. The half-fitted condition of the connector can be detected in a double manner through the lock arm and the provisionally-retaining arm, and therefore the detection accuracy is enhanced. In the present invention, if any of the plurality of male connector housings is in a half-fitted condition, the slide member can not be slid, and therefore the half-fitted condition of the connector can be positively detected.

What is claimed is:

1. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing between said connector fitting chamber and said slide member; and a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm.

2. The connector lock structure of claim 1, wherein a portion of a bottom surface of the slide member, disposed adjacent to the flexure reception portion, can abut against a surface of the lock arm facing in a direction of flexing of the lock arm.

3. The connector lock structure of claim 2, further comprising:

a guide groove formed in the female connector housing;

a slide protuberance formed on the male connector housing, wherein, when the male connector housing is inserted into the connector fitting chamber, the slide protuberance is guided by the guide groove; and an elastic, provisionally-retaining arm formed on the slide member, wherein the slide member is provisionally retained to the female connector housing so that the provisionally-retaining arm is engaged with the guide groove, and wherein, when the male connector housing is inserted into the connector fitting chamber, the provisionally-retaining arm is pressed by the slide protuberance, so that a provisional retainment of the slide member is canceled by disengaging the provisionally-retaining arm from the guide groove.

4. The connector lock structure of claim 2, in which a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

5. The connector lock structure of claim 3, in which a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

6. The connector lock structure of claim 1, further comprising:

a guide groove formed in the female connector housing;

a slide protuberance formed on the male connector housing, wherein, when the male connector housing is inserted into the connector fitting chamber, the slide protuberance is guided by the guide groove; and an elastic, provisionally-retaining arm formed on the slide member, wherein the slide member is provisionally retained to the female connector housing so that the provisionally-retaining arm is engaged with the guide groove, and wherein, when the male connector housing is inserted into the connector fitting chamber, the provisionally-retaining arm is pressed by the slide protuberance, so that a provisional retainment of the slide member is canceled by disengaging the provisionally-retaining arm from the guide groove.

7. The connector lock structure of claim 6, in which a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

8. The connector lock structure of claim 1, in which a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

9. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing;

a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm;

a guide groove formed in the female connector housing;

a slide protuberance formed on the male connector housing, wherein, when the male connector housing is inserted into the connector fitting chamber, the slide protuberance is guided by the guide groove; and an elastic, provisionally-retaining arm formed on the slide member, wherein the slide member is provisionally retained to the female connector housing so that the provisionally-retaining arm is engaged with the guide groove, and wherein, when the male connector housing is inserted into the connector fitting chamber, the provisionally-retaining arm is pressed by the slide protuberance, so that a provisional retainment of the slide member is canceled by disengaging the provisionally-retaining arm from the guide groove.

10. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing;

a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm;

wherein a portion of a bottom surface of the slide member, disposed adjacent to the flexure reception portion, can abut against a surface of the lock arm facing in a direction of flexing of the lock arm;

a guide groove formed in the female connector housing;

a slide protuberance formed on the male connector housing, wherein, when the male connector housing is inserted into the connector fitting chamber, the slide protuberance is guided by the guide groove; and an elastic, provisionally-retaining arm formed on the slide member, wherein the slide member is provisionally retained to the female connector housing so that the provisionally-retaining arm is engaged with the guide groove, and wherein, when the male connector housing is inserted into the connector fitting chamber, the provisionally-retaining arm is pressed by the slide protuberance, so that a provisional retainment of the slide member is canceled by disengaging the provisionally-retaining arm from the guide groove.

11. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing;

a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm; and wherein a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

12. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing;

a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm;

wherein a portion of a bottom surface of the slide member, disposed adjacent to the flexure reception portion, can abut against a surface of the lock arm facing in a direction of flexing of the lock arm; and wherein a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

13. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing;

a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm;

a guide groove formed in the female connector housing;

a slide protuberance formed on the male connector housing, wherein, when the male connector housing is inserted into the connector fitting chamber, the slide protuberance is guided by the guide groove;

an elastic, provisionally-retaining arm formed on the slide member, wherein the slide member is provisionally retained to the female connector housing so that the provisionally-retaining arm is engaged with the guide groove, wherein, when the male connector housing is inserted into the connector fitting chamber, the provisionally-retaining arm is pressed by the slide protuberance, so that a provisional retainment of the slide member is canceled by disengaging the provisionally-retaining arm from the guide groove; and wherein a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

14. A connector lock structure, comprising:

a female connector housing having a connector fitting chamber;

a male connector housing insertable into the connector fitting chamber, the male connector housing having an engagement projection;

a slide member mounted to the female connector housing so that the slide member is slidable in a direction perpendicular to a connector fitting direction;

an elastic lock arm disposed in the female connector housing;

a flexure reception portion formed in the slide member, wherein, when the male connector housing is inserted into the connector fitting chamber, the engagement projection raises the lock arm so that at least a part of the lock arm is inserted into the flexure reception portion, and an inner side surface of the flexure reception portion is abut against a side surface of the lock arm;

wherein a portion of a bottom surface of the slide member, disposed adjacent to the flexure reception portion, can abut against a surface of the lock arm facing in a direction of flexing of the lock arm;

a guide groove formed in the female connector housing;

a slide protuberance formed on the male connector housing, wherein, when the male connector housing is inserted into the connector fitting chamber, the slide protuberance is guided by the guide groove;

an elastic, provisionally-retaining arm formed on the slide member, wherein the slide member is provisionally retained to the female connector housing so that the provisionally-retaining arm is engaged with the guide groove, wherein, when the male connector housing is inserted into the connector fitting chamber, the provisionally-retaining arm is pressed by the slide protuberance, so that a provisional retainment of the slide member is canceled by disengaging the provisionally-retaining arm from the guide groove; and wherein a plurality of the connector fitting chambers are provided in a juxtaposed manner in the female connector housing, and a plurality of the lock arms, corresponding respectively to the connector fitting chambers, are provided at the female connector housing, and a plurality of the flexure reception portions, corresponding respectively to the connector fitting chambers, are provided at the slide member.

* * * * *